United States Patent [19]

Isino et al.

[11] 4,173,231

[45] Nov. 6, 1979

[54] HAIR DRYER ATTACHMENT

[75] Inventors: Koichi Isino; Hisakichi Nose, both of Hikone, Japan

[73] Assignee: Matsushita Electric Works, Ltd., Osaka, Japan

[21] Appl. No.: 847,045

[22] Filed: Oct. 31, 1977

[30] Foreign Application Priority Data

Oct. 30, 1976 [JP] Japan ..... 51-130605

[51] Int. Cl.[2] ..... A45D 20/00

[52] U.S. Cl. ..... 132/9

[58] Field of Search ..... 132/9, 11 R, 85, 120, 132/150; 34/91-97; 219/373, 369, 370; 15/396-398, 408, 418, 420

[56] References Cited

U.S. PATENT DOCUMENTS

| | | | |
|---|---|---|---|
| 883,598 | 3/1908 | Warren | 132/151 |
| 1,642,636 | 9/1927 | Wright | 132/150 X |
| 1,716,617 | 6/1929 | Brockelsby | 132/84 B |
| 1,833,434 | 11/1931 | Priest | 132/84 B |
| 2,862,226 | 12/1958 | Peale | 15/395 |
| 3,599,345 | 8/1971 | Tolmie | 132/9 |
| 3,929,142 | 12/1975 | Carfi | 132/9 |
| 3,931,826 | 7/1976 | Moon | 132/9 |

*Primary Examiner*—G. E. McNeill

*Attorney, Agent, or Firm*—Burns, Doane, Swecker & Mathis

[57] ABSTRACT

A hair dryer attachment improved in the effect of application of hot air from dryer body to hair wound on the attachment and in the function of achieving hair dressing with natural feeling is provided. A substantially cylindrical body of the attachment mounted at an open end to air-blowing port of the dryer body has hot-air delivery ports respectively extending between respective arrays of hair combing and holding bristles and in direction transversing the longitudinal axis of the cylindrical body as spaced from one another, and each delivery port has a width in said direction smaller than its depth in direction of communicating with inner hollow space of the cylindrical body. Such width of the delivery ports is preferably made gradually smaller as the ports approach closed tip end of the attachment opposing the open end.

2 Claims, 9 Drawing Figures

HAIR DRYER ATTACHMENT

This invention relates generally to hair dryers and, more particularly, to improvements in hair treating attachment to hair dryers.

An example of conventional attachment to hair dryers is shown in FIGS. 1 and 2. In the drawings, an attachment 2 is fitted to a dryer body 1 and is provided with a central hot air delivery port 3 made substantially in the middle, sideward delivery ports 4 made on the respective sides of the port 3 and brush bristles planted 5 on the surface between the respective ports 4 and the port 3. In this structure, there have been defects that, as the delivery ports 3 and 4 extend long in the axial direction of the attachment body 2, hot air from the dryer body 1 will be delivered out of these ports 3 and 4 in the directions indicated by the arrows in FIG. 3 along the axial line of the attachment body 2 and, therefore, will not be efficiently applied to hairs held by the bristles 5 and that, with the brush bristles for winding hair thereabout, hair cannot be dressed to be of a rough or soft and natural feeling. The present invention has been suggested to eliminate these defects.

A primary object of the present invention is to provide an improved attachment to hair dryers which can efficiently apply hot air to hair.

Another object of the present invention is to provide an attachment to hair dryers having a function of dressing hair to be of rough and natural feeling.

Other objects and advantages of the present invention will become clear upon reading the following description of the invention detailed with reference to a preferred embodiment shown in the drawings, in which.

The present invention shall be explained more particularly in the following with reference to the illustrated preferred embodiment. However, it should be understood that the present invention is not to be limited to the particular embodiment shown herein but is rather intended to include various possible modifications, alterations and equivalent arrangements within the scope of appended claims.

Figure 1:
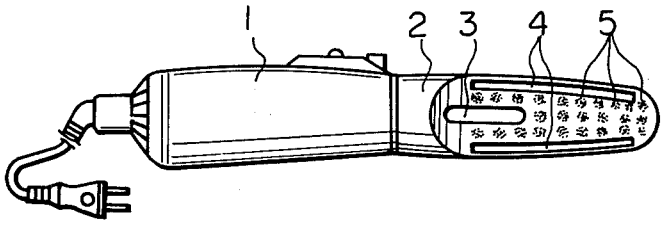
Fig. 1 (PRIOR ART)
FIGS. 1 and 2 show a conventional attachment to hair dryers in plan and perspective views, respectively.
Figure 2:
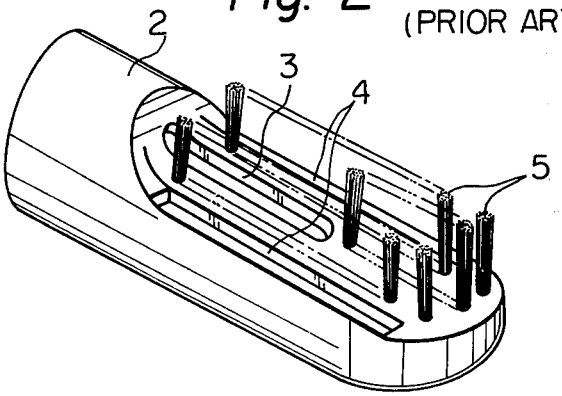
Fig. 2 (PRIOR ART)
Figure 3:
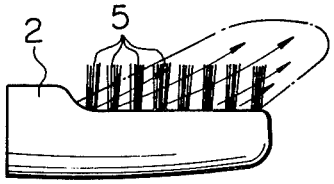
Fig. 3 (PRIOR ART)
FIG. 3 is an explanatory view of air blowing function of the attachment of FIG. 1.
Figure 4:
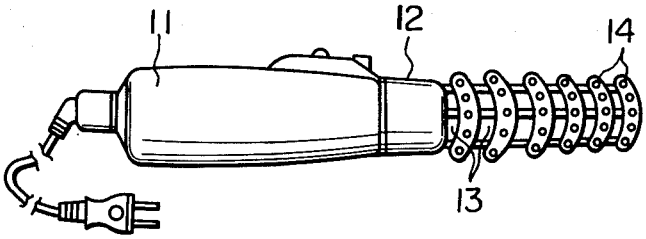
FIG. 4 is a plan view of an embodiment of the attachment according to the present invention as assembled with hair drier body.
Figure 5:
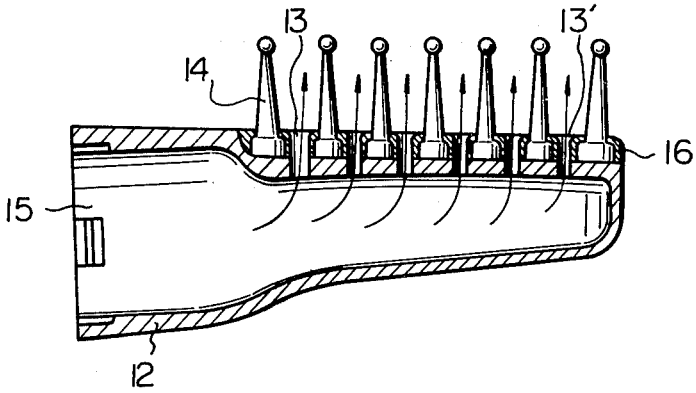
FIG. 5 is a longitudinally sectioned view of the attachment of FIG. 4.
Figure 9:
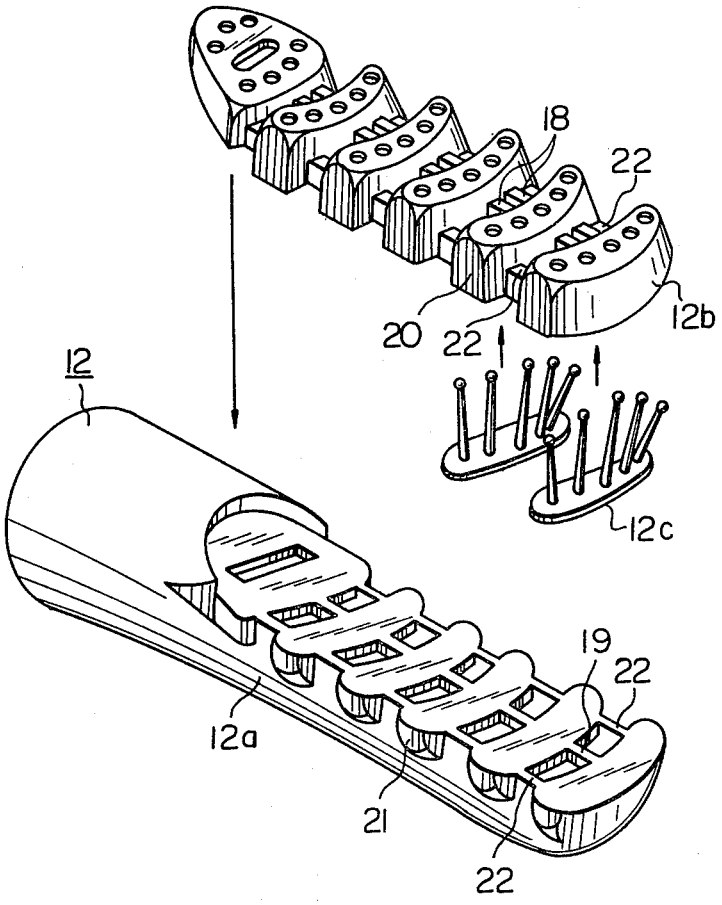
FIG. 9 is a perspective view of respective component of the attachment as disassembled of FIG. 4.

In FIGS. 4 and 5, an attachment 12 according to the present invention is fitted at its open end to an air-blowing end of a hair dryer 11 and is provided with a plurality of hot air delivery ports 13 arranged in several rows as spaced in the axial direction and a plurality of projections or bristle members 14 on the surface. In assembling this attachment, as shown in FIG. 9, first of all, bristle blocks **12*c* having a plurality of bristle members 14 made integral with the respective blocks 12*c* are fitted respectively to each recess 12*d* in the transverse bristle bases 12*e* of a bristle holder 12*b* so that the bristles project out of respective holes made in the bristle holder 12*b*, then the bristle holder 12*b* is coupled to a substantially tubular attachment body 12*a* so that the bristles 14 are secured to the attachment body. The transverse bristle bases 12*e* fit over corresponding transverse ribs 12*f* in the body 12*a*. In coupling the bristle holder 12*b* to the attachment body 12*a*, a pair of axially extending ribs 4 legs 18 of the bristle holder 12*b* are engaged with a middle rib 19 of the attachment body 12*a* and convexed pressing pieces 20 on both sides of the bristle holder 12*b* are engaged respectively with projecting parts 21 on both sides of the attachment body 12*a*. As shown in FIG. 5, the hot air delivery ports 13 are arranged in directions at right angles with respect to the longitudinal axis of the attachment. A hollow chamber 15 through which hot air is to pass is formed within the attachment body 12 and the delivery ports 13 communicate with this hollow chamber 15. The delivery ports 13 are formed by overlapping openings defined between the middle rib 19 and both end ribs 22 of the bristle holder 12*b* with openings on the upper surface of the attachment body 12*a* (see FIG. 5**).

Figure 6:
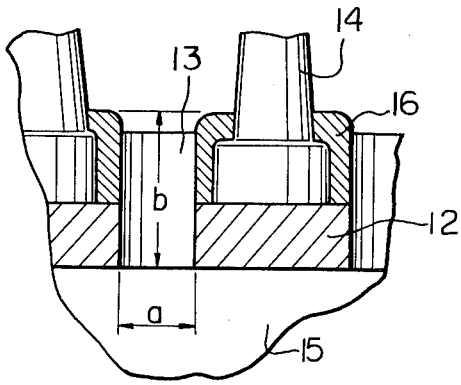
FIG. 6 is a fragmentary sectioned view as magnified showing one of hot air delivery ports in the attachment of FIG. 4.
Figure 7:
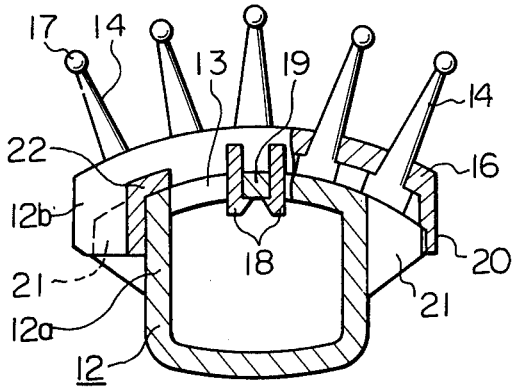
FIG. 7 is a transversely sectioned view of the attachment of FIG. 4 showing its bristle parts.

FIG. 6 is a view for showing the shape of the delivery port 13 more in detail. When the width in the axial direction of the delivery port 13 is made "a" and the depth of the delivery port is made "b", it is preferable that $a<b$. Therefore, as shown in FIG. 5, hot air from the dryer body 11 will be delivered out of the delivery ports 13 in directions at right angles with the axis of the attachment body so as to be efficiently applied to hair wound on the bristles 14.

In comparing the delivery port 13' closer to a closed tip end of the body **12*a* with those 13 closer to the open end of the body 12*a*, it is preferable that the delivery port 13' is smaller than the delivery port 13** in the cross-sectional area. Thus the cross-sectional areas of the delivery ports are made smaller with the approach to the tip end of the attachment so that the hot air delivering speed will be substantially the same irrespective of the position of the delivery port.

Referring to the structure of the projection or bristle, each bristle 14 is made smaller in the diameter with the approach to the tip and has a ball-shaped part 17 formed at the tip so that hair can be well caught by the bristles.

Figure 8:
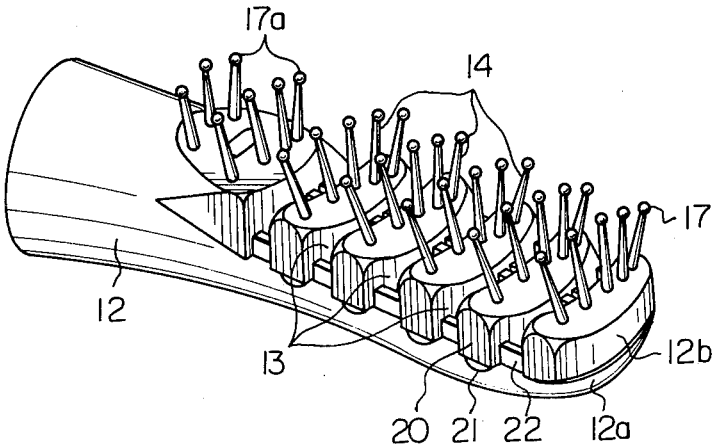
FIG. 8 is a perspective view of the attachment of FIG. 4.

As shown in FIG. 8, the respective bristles are arranged in a row in directions substantially at right angles with respect to the axial direction on the surface of the attachment body 12. However, it is also effective to arrange them substantially in arcuate distribution as shown by the bristles **17*a* in the part near the open end of the attachment body 12*a***.

Further, the convexes 20 provided on both sides of the attachment body **12*a* are effective in contributing to the rough finish of hair, in cooperation with concaves formed between the respective convexes 20**.

Thus, according to the present invention, as concaves and convexes are formed on both sides of the bristle holder, in the case of dressing hair, the hair touching the side surface parts of the attachment will be respectively different in the bending angle by the step difference between the concave and convex so that a concavo-convex feeling or a so-called rough feeling will be given to hair as finished.

Further, according to the present invention, as the respective bristles are coarsely arranged and have ball-shaped part formed at the tips, hair will be thereby gripped and held as floated considerably freely as different from being combed and dressed and will be finished to be of a rougher feeling.

Further, according to the present invention, as the plurality of delivery ports to deliver hot air out of the hollow chamber of the attachment along the bristles are formed of openings lying in directions coinciding longitudinally with the directions intersecting at right angles the axial direction of the attachment, that is, the hot air blowing direction, and are set so that their depths are larger than their widths, the hot air from the hollow chamber will advance straight to the wound hair through the delivery ports so as to efficiently dry wet hair.

Further, according to the present invention, as legs are provided on the lower surface of the bristle holder holding the bristle blocks and are engaged with the middle rib of the attachment body to fix the bristle holder to the attachment body, the attachment can be formed simply.

What is claimed is:

1. A hair dryer attachment comprising an elongate cylindrical body closed at an axial end and opened at the other axial end for mounting the body to an air blow-off port of a hair dryer, said body having a longitudinal axis and comprising a plurality of parallel ribs extending transversely relative to said longitudinal axis, a plurality of longitudinally spaced slots located between said ribs, said transverse ribs extending transversely beyond said slots to form lateral projections, and an elongate bristle fixture comprising a plurality of parallel bristle bases extending transversely relative to said longitudinal axis and interconnected by longitudinal ribs, the quantity and shape of said bases corresponding to that of said transverse ribs in said cylindrical body, and a plurality of rows of bristles extending from respective ones of said bristle bases, said bristle fixture being mounted on said body, with said bristle bases being fitted over said transverse ribs and with both ends of said transverse bristle bases engaging said lateral projections of the body, said slots each having a depth extending in a direction substantially perpendicular to said longitudinal axis for allowing an air stream from the hair dryer to be blown through the slot in a direction perpendicular to said axis, and said slots and rows of bristles lying substantially in directions intersecting said longitudinal axis at right angles to deliver said blown air stream to hair caught between the respective bristle rows.

2. A hair dryer attachment according to claim 1, wherein said body further includes a longitudinally extending rib positioned centrally of said slots, said longitudinal ribs of the bristle fixture clampingly engaging said longitudinal rib of said body to secure the fixture to the body.

* * * * *